United States Patent [19]

Shore

[11] 4,344,473

[45] Aug. 17, 1982

[54] MEANS FOR SEPARATING LIGHT REFLECTIVE FABRICS

[76] Inventor: Ronald H. Shore, P.O. Box 130, Snowmass, Colo. 81654, Jill Shore, conservator

[21] Appl. No.: 86,654

[22] Filed: Oct. 22, 1979

Related U.S. Application Data

[63] Continuation-in-part of Ser. No. 833,581, Sep. 15, 1977, and a continuation-in-part of Ser. No. 907,707, May 19, 1978.

[51] Int. Cl.[3] ..... E06B 9/08

[52] U.S. Cl. ..... 160/121 R

[58] Field of Search ..... 160/6, 11, 25, 41, 84 R, 160/84 M, 120, 121, 122, 237, 238, 271, 242; 49/47; 29/407, 427, 428

[56] References Cited

U.S. PATENT DOCUMENTS

| | | | |
|---|---|---|---|
| 2,328,257 | 8/1943 | Butts | 160/121 |
| 3,110,343 | 11/1963 | Guffan | 160/11 |
| 3,236,290 | 2/1966 | Lueder | 160/241 |
| 3,860,055 | 1/1975 | Wild | 160/6 |
| 3,918,512 | 11/1975 | Kuneman | 49/477 |
| 4,039,019 | 8/1977 | Hopper | 160/121 R |
| 4,095,639 | 6/1978 | Ryan | 160/84 R |

FOREIGN PATENT DOCUMENTS

| | | | |
|---|---|---|---|
| 756270 | 9/1956 | United Kingdom | 160/84 R |

*Primary Examiner*—Peter M. Caun

*Attorney, Agent, or Firm*—Laff, Whitesel & Rockman

[57] ABSTRACT

This invention relates to dynamic devices for insulating wall surfaces and especially surfaces including a window. A self-inflating solar curtain may be automatically raised and lowered in response to the direction of heat flow into or out of a confined space within which the temperature is to be controlled. This confined space could be a solar collector, a room in a house, or another enclosure requiring temperature control. The curtain comprises at least one double-walled, air-entraining envelope with vents at the bottom for enabling an inhaling or exhaling process which takes air into and expels air from the envelope as the curtain is heated or raised, respectively. The curtain may be wound upon and stowed on a roller driven by a motor or other suitable means. A comb-like structure separates the top of the air-entraining envelope to insure an internal spreading of the curtain all of the way up to its top. This spreading is most important for smaller curtains and for curtains made of a material which clings to itself responsive to static attraction.

20 Claims, 14 Drawing Figures

MEANS FOR SEPARATING LIGHT REFLECTIVE FABRICS

This is a continuation-in-part of my U.S. Patent applications Ser. No. 833,581, filed Sept. 15, 1977, and a continuation-in-part of Ser. No. 907,707, filed May 19, 1978.

This invention relates to means for and methods of insulating walls and especially—although not exclusively—windows in buildings or solar collectors, and more particularly to self-inflating solar curtains.

A room, building, solar collector, or other enclosure having a window or other glazed area, usually acts as a passive solar collector. The solar energy entering the enclosure is absorbed and effectively stored by raising the temperature of the enclosed air mass and surrounding objects. The efficiency with which this stored energy can be retained is a function of the overall insulation of the structure.

Usually, permanently installed, commercially available insulating materials rest passively in the walls, under the floors and over the ceiling to reduce heat losses to acceptable levels. However, even doubly or triply glazed window areas account for abnormally high energy losses. About the only known way of reducing these losses is to cover the glazed area with a movable insulation.

In the summertime operation, these glazed areas should by covered during those periods in which the solar energy gains exceed the energy losses. Otherwise, nonrenewable energy sources must be called upon for cooling. Conversely, during summer nights, the insulation should be removed to dissipate the unwanted energy by radiating it outwardly to the clear night sky.

To automatically control the curtain position responsive to temperature differentials on opposite sides of the curtain, a motor driven roller may be placed over and attached to the top edge of the curtain. In the summer mode, the control system automatically lowers the curtain when the temperature on the side of the curtain nearest the glazing exceeds the temperature on the opposite (room) side. During summer, the curtain is raised when the opposite temperature condition exists. In the winter mode, the controls system raises the curtain when the sun is out and lowers it at night.

The invention finds use when it is either necessary or desirable to have a wall of adjustable insulation. For example, an obvious use of any curtain is to hang it in front of a window used to give people a view into or out of a house. However, with the increasing energy problems, many other glazed areas are being installed on housings, purely for heating purposes. For example, many solar collectors are boxes or other enclosures of limited volume, having a window sealed over one side. Sunlight passes through the window and heats the enclosed mass entrapped inside the box. Then the heated mass may be used for any suitable purposes, such as radiating its heat to the adjacent conditioned space. Many of these solar energy collectors are merely passive devices which simply sit there waiting for the sun to shine upon them. There is nothing which may accelerate an accumulation of heat without equally accelerating a loss of heat. The invention adds to these passive collectors the dimension in the water mode of a controllable insulating element which can increase the overall efficiency of the collectors by a reduction in the heat losses to the outside environment.

Therefore, an object of the invention is provide a novel and improved self-inflating solar curtain having two or more curtain panels which may be placed in front of or removed from glazed areas or other wall surfaces of an enclosure. An additional object is to selectively lower the inventive curtain with assurance that the curtain will fully inflate to the top by providing means for separating the curtain panels near the top of the curtain.

A further object of the invention is to provide curtain separators for multi-sheet curtains mounted to move between rolled and deployed positions.

Another object is to provide a more efficient temporary heat transfer barrier or insulating medium of the class described, especially for smaller windows.

Yet another object of the invention is to provide a self-inflatable curtain which automatically increases or decreases its insulating capacity as a function of changes in the demand for insulation. In particular, an object is to reduce the demands for nonrecoverable energy to the minimal needs required to raise and lower the curtain.

Still another object is to provide a unique assembly of opposed channels, tracks and separators which cooperate with one another to provide an air-entraining envelope.

Further objects of the invention are to provide a self-inflating curtain that is efficient, lightweight, readily adaptable to various sizes of glazed areas, versatile, convenient, easy to install and operate. In this connection, an object is to provide a unit of the type described which is decorative and can be made compatible with almost any room decor.

In accordance with an aspect of the invention these and other objects are accomplished by a self-inflating curtain which forms a removable insulation barrier. At least two layers of curtain material are maintained in a permanently spaced apart relationship by a suitable spreader attached to or adjacent the bottom portion of the layers. The top of the layers of curtain material are closed for preventing an escape of trapped air. In addition, suitable fingers may be inserted between each pair of layers near the top of the curtain to separate them and prevent them from clinging to each other, thereby inhibiting inflation at the top. The curtain envelope has openings distributed along its lower edge to enable it to inhale and thereby draw in additional air as the residual air confined in the curtain is heated and to exhale and thereby deflate the curtain when it cools or is rolled up. Two such double-walled curtains may be placed one inside the other, with a single layer of curtain material disposed within the inside and smaller of the two curtains in order to form four separate dead air pockets. If so, four separation fingers may be positioned between the curtain layers which form these four pockets near the top of the curtain.

Other objects will become more apparent from the following description and the attached drawings in which.

Figure 1:
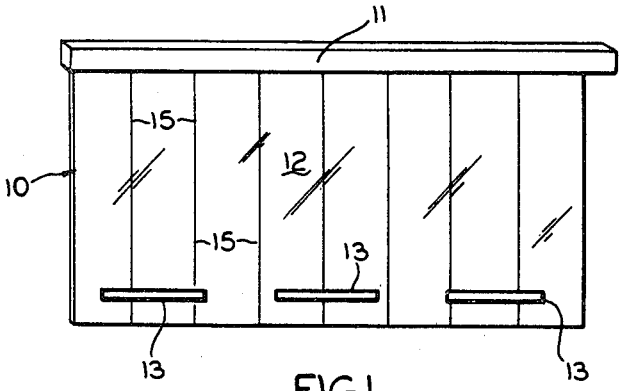
FIG. 1 is an elevation view of the inventive solar curtain in a lowered and deflated condition.
Figure 3:
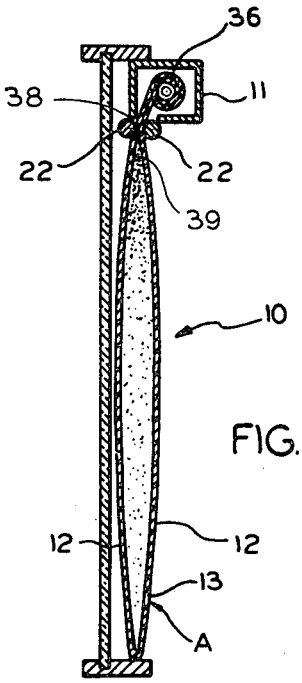
FIG. 3 is a cross-sectional view taken along line 3—3 of FIG. 2.
Figure 2:
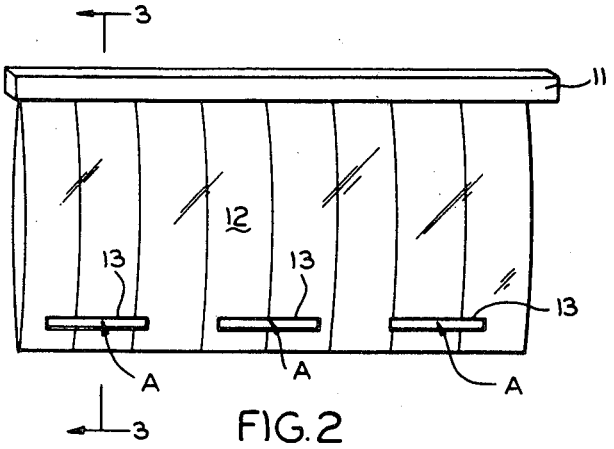
FIG. 2 is a similar view of the same curtain while it is inflating.
Figure 4:
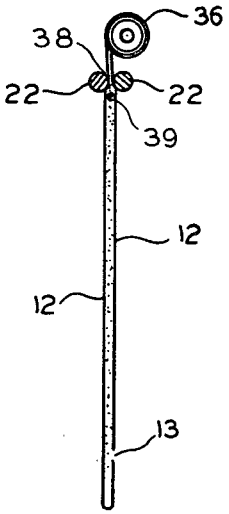
FIG. 4 is a schematic side view of a lowered curtain before it self-inflates.

FIGS. 1–5 schematically illustrate the invention and the principles used to provide the inventive features. For example, FIGS. 1 and 2 may be thought of as showing a ceiling to floor curtain which is any convenient width (such as approximately twenty feet) and height (such as ten feet). The curtain has at least two individual side panels 12 which define between them a dead air space, each side panel being formed by a suitable film through which air will not pass. The two side panels are periodically switched or otherwise bonded together, as shown at 15, in order to form a plurality of vertically extending air bags. In one preferred embodiment, each side panel 12 may be a light weight sheet of fabric, having an air impervious layer (such as polyester) laminated thereto. In another case, the panels may simply be a sheet of plastic, such as "Mylar" polyester. The bottom region of at least one of the panels 12 and of each air bag formed by the panels is pierced by horizontal slots or other suitably distributed openings 13.

The curtain hangs freely from a valance 11 which is attached above the window and to its supporting structure. A motor driven roller (similar to a window shade roller) 36 is contained within the valance 11. The curtain is attached to and hangs from the roller 36. As the curtain is unrolled, it passes from the roller 36 and travels between a pair of pinch rollers 22,22, which extend over the entire width of the curtain. These pinch rollers are separated by a space (herein called a "deflation groove") which is wide enough for the curtain to pass freely into or out of the valance 11. However, the separation of the deflation groove does not provide any appreciable space in addition to that which must be provided to enable the curtain to pass through it. Therefore, almost all air is squeezed from between the side panels 12 and out the slots 13 as the curtain is rolled up on the roller 36.

When the curtain is first rolled down (FIG. 4), the two panels 12,12 are closely spaced. There will inherently be a small amount of air entrapped within the curtain, which is represented in the drawing by stippling between panels 12,12. The quantity of air entrapped in the curtain may be increased by separating the layers 12, 12 of the material near the pinch rollers 22. This may be accomplished by attaching comb-like separators such as fingers 39 to each track 14, extending between adjacent panels 12. These fingers also keep the opposing top sides of the curtain from clinging to each other after the curtain is lowered.

Figure 5:
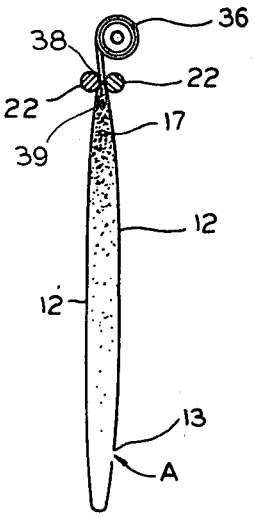
FIG. 5 is a schematic side view of the same curtain as it is inflating.

When the curtain heats, as under sun loading, this entrapped air expands and rises (FIG. 5). Thus, virtually all of the air originally entrapped between the curtain panels 12 is shown by stippling 17 (FIG. 5) as having risen to be near the deflation groove defined by the pinch rollers 22,22. Since the curtain is rolled around the roller 36, the top of the air bag is sealed, and the rising air cannot escape. The increased volume of this risen air causes the opposing side panels 12 to spread apart and to hang, under gravity, thereby increasing the volume enclosed by the curtain panels. When the air inside the bag is not as dense as the air outside the curtain, air is drawn through slots 13, by an inhalation process, as indicated by Arrows A on FIGS. 2 and 5.

The amount of air that is thus inhaled by the curtain automatically varies as a function of changes in the density of the air which, in turn, varies responsive to changes of the surrounding heat. The hotter the entrapped air becomes, the more it rises and the greater the volume between panels 12 becomes. Thus, more air is inhaled and entrapped. Conversely, as the curtain cools, the relatively cooler air tends to sink and the volume of the curtain tends to reduce as the weight of the panels 12 draws them together.

A more detailed description of the automatic curtain control of the present invention is provided in connection with FIGS. 6–11, inclusive. The solar curtain assembly 10 includes, among other things, opposite side panels 12,12, and a spaced parallel pair of vertical tracks 14, which embrace the side margins of the curtain panels 12,12. Separating structures 39 are attached to each track 14, projecting between each pair of curtain layers to separate the panels 12, 12 as the curtain is rolled down. The separators 39 facilitate the entry of air into the panels 12, 12 adjacent the tracks 14. A suitable spreader 16 is cradled in a fold 18 at the bottom of the air-entraining envelope 20 formed by the opposing side panels 12,12.

Preferably, there are two such folded panels which are here designated 20A, 20B, 20D, 20E. Each of these panels cradles a spreader 16. The lower spreader 16 might be in the order of one and one-half inches in diameter. The upper spreader 16 should be approximately one half the diameter of the lower spreader or in the order of three-quarters of one inch in diameter if the lower one is one and one-half inches. These spreaders are preferably lightweight plastic (such as PVC) rods and are left free to roll in the bottom fold as the curtain is rolled up or down. This way, it is irrelevant whether one of the side panels 12 tends to roll up faster than the other. In the center of the inner folded panel, there is a singly hanging sheet or panel 20C, which is held vertically by a weight 44C. A horizontally-disposed pair of pinch rollers 22,22 are positioned on opposite sides and near the top of panels 12,12 in order to form the deflation groove running along the entire width of the curtain.

Preferably, the insulation of a confined air space 24, such as within a room of a home, office, or solar collector is to be controlled by the curtain. A window frame or casement 26 is set in an exterior wall 28 to form the frame of a glass pane 30. Any suitable glazing may be provided.

A pair of spaced parallel, vertically extending tracks 14 are mounted on the wall 28 bordering the window frame 26. Each track 14 defines an inwardly-opening generally C-shaped channel 32 which is most clearly revealed in the horizontal cross section in FIG. 10. The inside channels 32 of the two tracks are essentially vertical and oppose one another in transversely-spaced parallel relation. The channels cooperate with one another and with the open side margins 34 of each air-entraining envelope 20 in order to confine and entrap air. As is most clearly revealed in FIG. 10, the outside folded curtain panels 20A, 20E, the inside folded curtain panels 20B, 20D, and the central single sheet 20C, together form five spaced parallel layers. The layer which is exposed to view through the window is preferably a nylon scrim having a laminated layer of polyester coated by a reflective material. The other four layers which are not exposed to view are preferably a scrim having aluminum vacuum deposited thereon.

These sheets have some body so that they do not easily come out of the C-shaped channel. Therefore, as the air inside the curtain expands, the vertical edges of the two outside curtain panels tend to seat and seal themselves against the sides of the channel 14. The seal is not perfect so that some air may tend to leak from between the tracks 14 and the curtain panels 20A and 20E. However, any such leakage is immediately replaced by the inhaled air, entering slots 13.

The curtain itself comprises at least two, and preferably four or five layers of a relatively thin flexible material. These layers are rolled up and stored on the overhead storage roller 36 (FIGS. 3–5) which is mounted in a position to receive the various layers of the curtain as they pass up through the deflation groove 38 between the pinch rollers 22, 22. A curtain which is 24 feet long and 16 feet high was actually stored in a roll approximately six inches in diameter.

In the preferred forms of the invention, the layers of the curtain are coated with a substance of high reflectivity (S) and low emissivity. Functionally, this coating is most beneficial in preventing energy loss from the direction toward which they are facing. Therefore, when they are being used to prevent energy loss from a heated mass (confined air space 24), they should face toward this mass. If the material is coated on only one of its two surfaces, the application is one primarily of solar heating. When the curtain is a multilayered one as illustrated, the single outside layer next to the window should have the coating on the exterior surface. All the other layers should then have their coatings facing into the room, as indicated at "S" in FIGS. 8 and 10.

Any gain in insulating value through a use of a thicker layer for the curtain panels is relatively insignificant. It is more important to use several spaced apart layers of thinner material, provided that each panel has adequate strength and body to hang properly, and that it is capable of being wound on a storage roller.

FIGS. 6–9 show that the curtain preferably includes an outer and an inner doubled layered air-entraining envelope, together with a fifth single layer 20C lying midway between the panels of 20B, 20D, which form the inner envelope. Thus, in the inflated condition shown in FIGS. 8, 10, these five layers cooperate with one another to form and define a total of four essentially dead air pockets 40A, 40B, 40C, and 40D.

In the particular form shown, both the outer and inner air-entraining envelopes are formed from a single sheet of material folded over at the bottom, such as at folds 42A and 42B. Each fold cradles therein one of the spreaders 44A and 44B. Hanging from the lower margin of single layer 20C is an elongate weight 44C which differs from spreaders 44A and 44B in that it performs no spreading function. All three members 44 act as both weights and guide members. The diameter of spreader 44A is somewhat less than the inside width of channels 32. However, all three elements 44 should preferably be long enough to fit against the channels, on both ends thereof. The ends of the three members 44 are thus confined within the channels 32 of opposed tracks 14 for confining the open-sided pockets as well as to guide the curtain up and down the tracks.

The air-entraining envelopes 20A and 20B need not necessarily be fabricated from a single sheet of material which is folded along the bottom. The curtain would function equally well by using separate layers of material which are bonded or otherwise fastened together at the bottom. Alternatively, separate sheets may be fastened to the spreader rather than to one another. The folded configuration is preferred since it is the simplest to make assuming that the layers of each envelope can have the proper face coated with a reflective layer.

Figure 6:
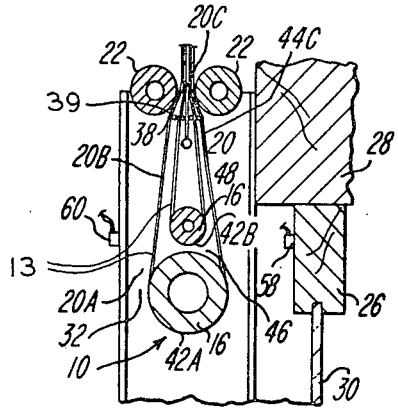
FIG. 6 is a vertical cross section, partly broken away, showing the inventive self-inflating curtain and associated elements of a deflating assembly, which includes part of the supporting building structure, the curtain being shown in its raised position.
Figure 6:
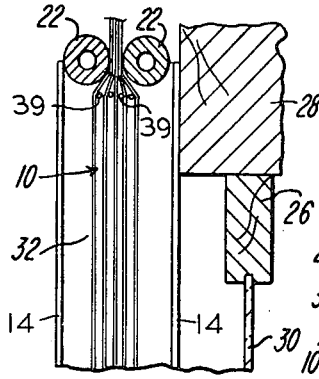
Figure 6:
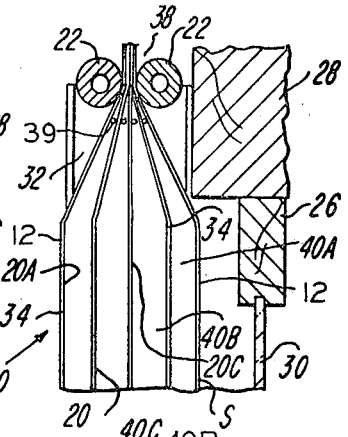
Figure 6:
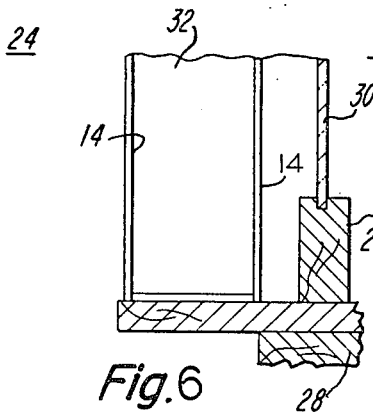
Figure 7:
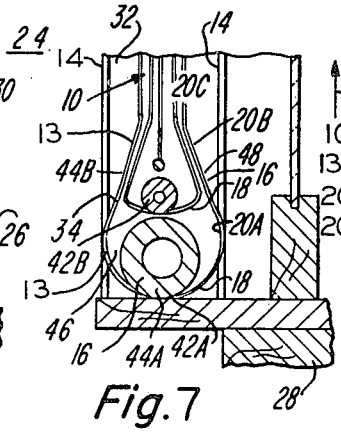
FIG. 7 is a view similar to FIG. 6 showing the curtain lowered into the insulating position before its inflation.

In FIGS. 6 and 7, it is seen that spreaders 44A and 44B, in conjunction with the fingers 39, always maintain a certain amount of residual air space in the pockets regardless of whether the curtain is raised or lowered. Communicating into the interior of these permanent air pockets 46 and 48 (FIGS. 6, 7 and 9), are the air intake openings 13. Air is expelled through both the openings 13 and the open side margins responsive to a raising of the curtain through the deflation groove 38 between pinch rollers 22,22.

When the curtain is completely raised into the stored position of FIG. 6, the size of the permanent pockets 46 and 48 is limited by the pinch rollers so that little air remains in the curtain. On the other hand, when the deflated curtain is lowered into the position in front of the glazed area of FIG. 7, the air which fills the pockets 46 and 48 is heated by the radiant energy from either the sun shining through the window during the day time or, alternatively, by the room air or radiating thermal mass at night during the winter. As it warms, the air within the curtain rises to the top of the pockets, thus inflating them. At the same time, and by an inhaling process, the spreading curtain draws in fresh air from the room (confined space 24) to supplement the air which is already in the pocket when the curtain is rolled down. Actually, the outer envelope 40A, 40D gets the initial air from air space 24. The inner envelope 40B, 40C gets its air from the outer one.

Figure 8:
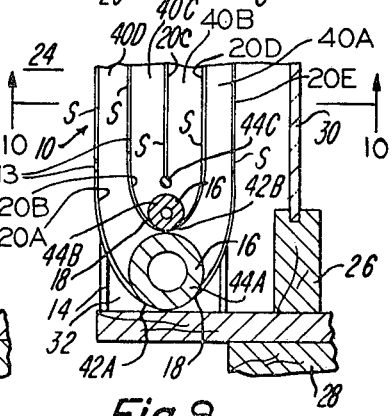
FIG. 8 is a view similar to both FIGS. 6 and 7, but different in that the curtain is shown inflated.
Figure 10:
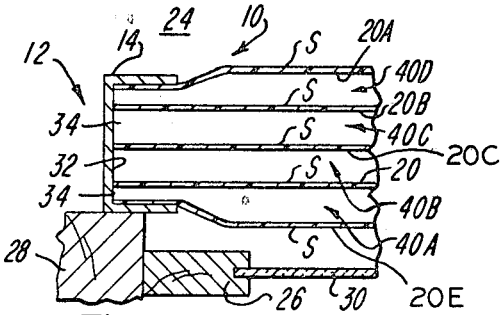
FIG. 10 is a fragmentary horizontal section taken along line 10—10 of FIG. 8.

In time, the pockets are filled to an equilibrium established by the surrounding temperature, as shown in FIG. 8. At this inflation point, the side margins of the outer envelope engage and seal themselves against the opposed inner surfaces of the tracks, as shown by the bulging edges in FIG. 10, thus cooperating with the pinch rollers 22, 22, and storage roller to trap the air within the pockets. If the air inside the curtain heats still more, the air inside expands to add still more volume of captured dead air, until the ultimate capacity of the curtain is finally reached. Once the curtain has inflated, as shown in FIGS. 8 and 10, the curtain provides excellent insulating qualities.

In a test run with the curtain illustrated in FIGS. 1 through 11, two identical enclosures were constructed, each of which had an open wall area that could be covered by materials whose insulation values were to be compared with that of the inventive inflatable curtain. The open areas were then glazed and identical heated masses placed within each enclosure. Thermocouples monitored the temperature of the masses, the enclosed air spaces and the air in the room where the test enclosures were situated. Such a test setup simulated conditions where an enclosure contains a window in an exterior wall and a medium which is heated for storing solar energy. The curtain used had five layers with the layer nearest the window having the reflective coating on the outside. The remaining four layers had the reflective coating on the inside, i.e., facing into the enclosure and away from the window. Approximately three-quarters of one inch of dead air space existed between each layer, thereby making a total of approximately three inches of insulation, since the thickness of each layer was negligible.

The other enclosure had a fiberglass batt, 3½ inches thick, placed in the same position, relative to the window, as the inflatable curtain was placed in the first enclosure. The exterior surface of this batt was covered with a reflective silver-colored foil.

The inventive curtain showed significantly better energy retention for the warm mass as compared to the retention by the reflective 3½ inch fiberglass batt. Conservatively, a so-called "R value" of "13" can be realized from use of the inventive curtain. Such an "R value" is quite close to the theoretical "R value" for the curtain on the basis of the calculations prescribed for insulating materials in the ASHRAE Handbook of Fundamentals, 1972 Edition. Tables for making such calculations for air spaces are found in the handbook. These table values are adjusted in accordance with the emissivity values found elsewhere in the same handbook.

Figure 9:
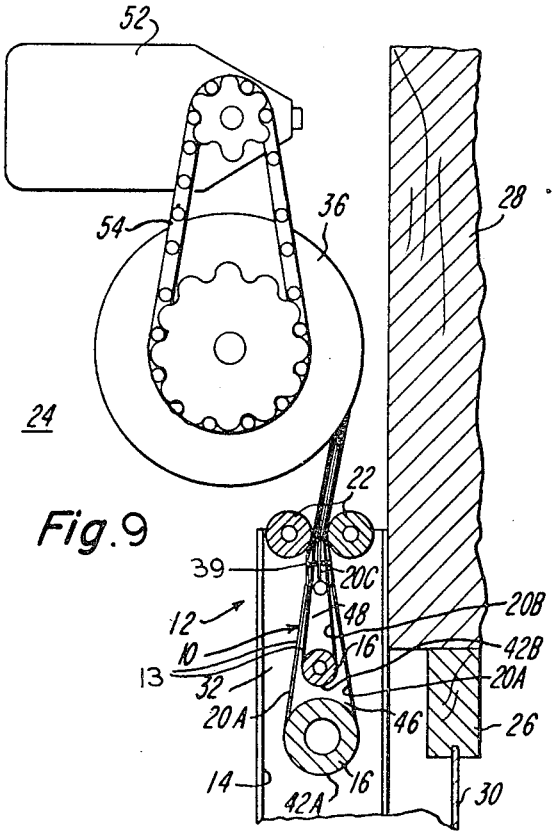
FIG. 9 is a fragmentary vertical section highlighting the curtain storage roller at the top of the curtain, a pair of deflating pinch rollers and several comb-like separators, and the drive mechanism for controlling the rotation of said roller.
Figure 11:
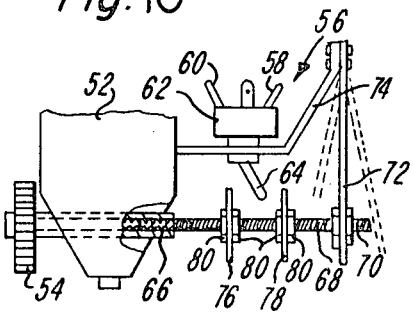
FIG. 11 is a fragmentary bottom plan view of a control mechanism and curtain driver of FIG. 9.

FIGS. 9 and 11 show that the storage roller 36 may, if desired, be driven by a reversible gear motor 52 for driving any suitable power transfer mechanism 54. The curtain is stored on roller 36 by winding it thereon in a window shade fashion.

In the summer when the sun is shining, the curtain should be lowered and allowed to self-inflate, as shown in FIGS. 8 and 10, to insulate the enclosure 24 and to prevent the solar energy from heating it. On the other hand, during the nighttime hours, the curtain should be raised into its rolled condition (FIG. 6), so that the heat within the room can escape through the glazed area and radiate to the clear night sky.

With specific reference to FIG. 11, the main features of an automatic control system 56 for raising and lowering the curtain are set forth in detail. Temperature sensors 58 and 60 are mounted on the outside and inside of the curtain, respectively. They detect and respond to the ambient temperature at these locations regardless of whether the curtain is raised or lowered. The outputs of these sensors are compared to determine which side of the curtain is warmer than the other side. Responsive to this comparison, the motor control switch 62 is actuated to energize or de-energize motor 52 so as to either raise or lower the curtain.

The sensors 58 and 60 may be set to respond to a particular temperature differential existing on opposite sides of the curtain. Alternatively, the circuit may be made to respond by energizing the motor to drive the curtain up or down whenever the temperature is different on one side, as compared to the other. Either way, these sensors coact to cause switch 62 to close, actuate the motor, and raise or lower the curtain, depending upon the direction of motor rotation. For example, the curtain may be normally down during the summer day, in response to a pre-existing condition sensed by sensors 58 and 60, namely, that the temperature between the curtain and the window is hotter than the temperature inside enclosure 24. When night falls and the enclosure sensor 60 senses an inside temperature which is greater than the temperature sensed between the curtain and the glass by the outside sensor 58, the curtain is raised to let the heat within closure 24 escape. After summer sun comes up, sensor 58 detects a higher temperature, closes switch 62 to actuate motor 52 and lower the curtain.

During the winter in cold climates, the situation is reversed. When the winter sun is out, the sensors actuate switch 62 to raise the curtain instead of lowering it so that the heat from the sun may enter and heat the enclosure 24. At night, the curtain is lowered to trap the heat inside the enclosure. Since this reversal in functions occurs only a few times a year, it is a simple matter to reverse the motor leads so that it runs in the opposite directions in response to the given sensor relationships. Alternatively, a simple reversing switch (not shown) can be provided to switch between winter and summer functions.

Means are provided for stopping the curtain at the upper and lower limits of its excursion. Such a feature is illustrated in FIG. 11; however, it is by no means the only way this stop function can be accomplished. The particular system shown employs an electromechanical turn counter to count the revolutions of the motor and therefore of roller 36. This counter is in the form of a conventional double-throw toggle switch 64 actuated to either energize or shut off motor 52 whenever curtain 10 reaches the preselected limit of its excursion, either up or down. A motor driven shaft 66 is hollow and internally threaded to receive screw 68. The outer end of the screw 68 is supported on an end of a spring arm 72 with any suitable support mechanism 70 which receives the end of the screw 68. Spring arm 72 is secured in place on a suitable bracket 74 which, in the particular form shown, also supports the toggle switch 64 along with other elements of the automatic curtain control assembly. A pair of switch-actuating members 76 and 78 are mounted in an axially-spaced relationship on the screw 68 and are maintained in an adjusted position therealong by means of nuts 80.

As viewed in FIG. 11, the motor turns shaft 66 in a direction which advances the screw 68 toward either the left or the right, depending upon whether the curtain is going up or down. Thus, actuating members 76, 78 are moved toward the toggle switch 64. One of these members ultimately engages and flips the switch to its alternate position (either left or right, depending upon the direction in which the screw 68 is turning). In so doing, the switch 62 shuts off the motor, thus stopping the curtain at one of its two extreme positions. After the switch flips, the next actuation of motor 52 is a rotation in an opposite direction to drive the screw 68 to a point where the other actuator returns the toggle switch to the position it formerly occupied. Spring arm 72 can bend to the extent necessary to accommodate the aforementioned screw movement. An advantage of this arrangement is that it counts the number of revolutions of the motor and therefore of the curtain roller.

Figure 14:
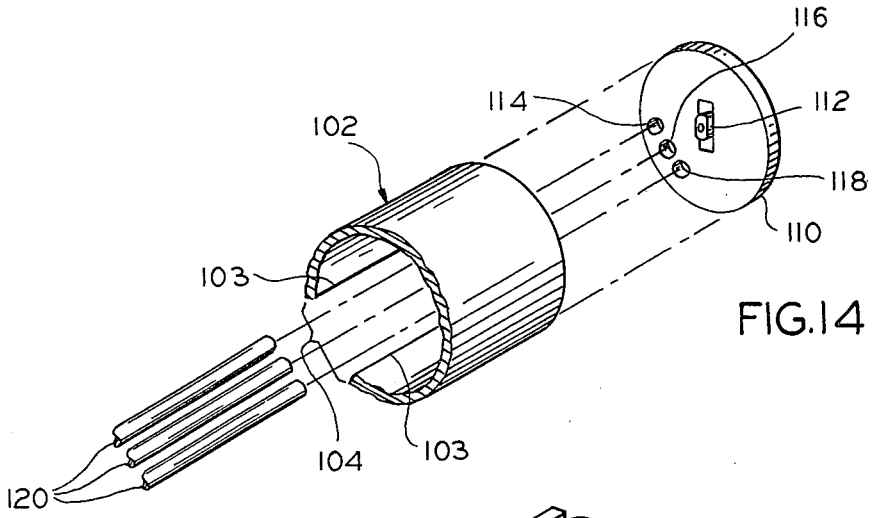
FIG. 14 is an exploded view of the top of the curtain and its support structure, for the embodiment of FIGS. 12,13.
Figure 12:
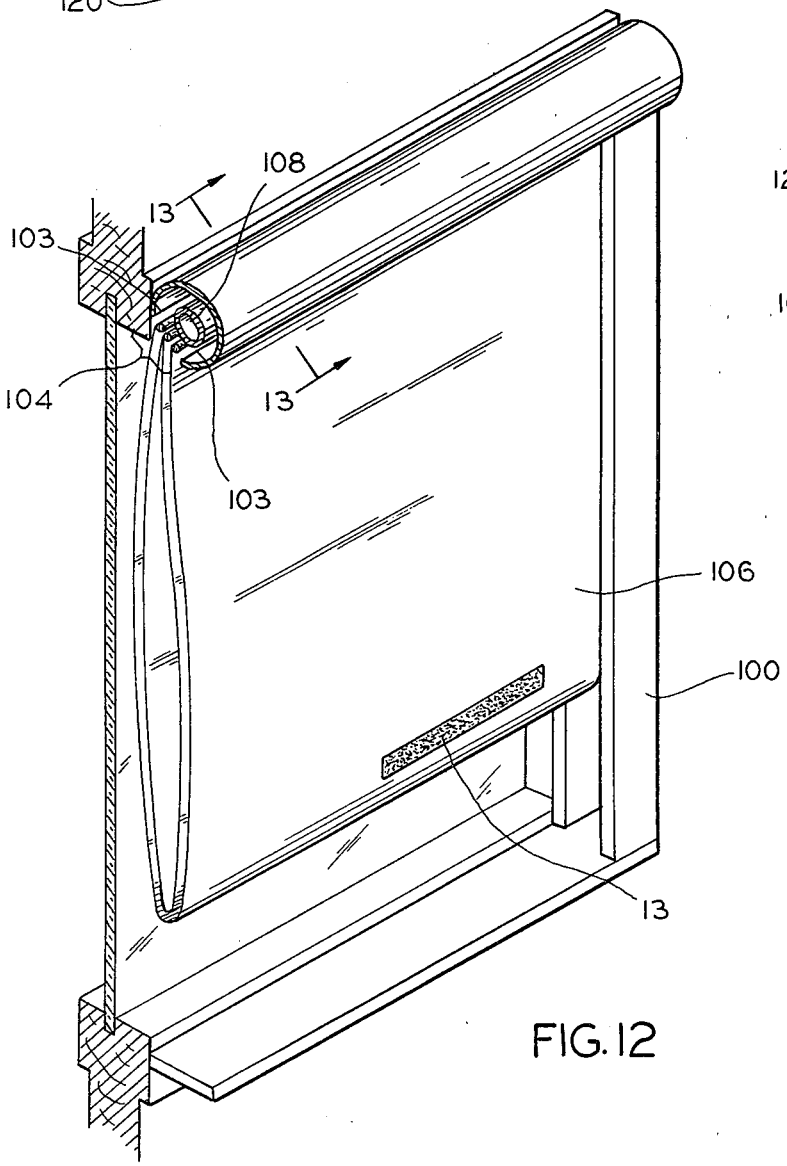
FIG. 12 is a partially cutaway view of an alternate embodiment of the curtain, especially a small curtain, shown in its lowered position.
Figure 13:
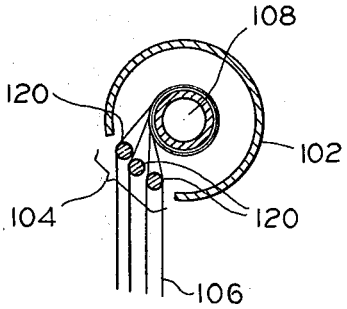
FIG. 13 is a cross-sectional view of the top of the curtain and its supporting structure, taken from the embodiment of FIG. 12, and highlighting the comb-like separators.

According to the invention, means are provided for separating opposing sides of the curtain and insuring that they do not cling to each other in an area near its top. An embodiment for achieving this end is shown in FIGS. 12–14. This particular embodiment is especially well suited for use on smaller windows where complete self containment, ease of installation, freedom from electrical control requirements, etc. are important. Nevertheless, similar structure may be applied to any structure which incorporates the invention.

In greater detail, the embodiment of FIGS. 12–14 includes spaced parallel pair of side rails or tracks 100 which may be made in the form of a vertical frame that fits against and is easily attached to the opposite sides of a frame of an existing window (for convenience of disclosure, only one of the two side rails is shown in FIG. 12). The tops of the opposed side rails 100 are attached to the ends of a generally cylindrical, shield-like member 102 having a slot 104 through which the curtain 106 must pass as it is rolled on a roller 108. The two sides 103 of the slot 104 define the deflation groove and serve the function of the pinch rollers 22, 22 in the previously described embodiments. The slot 104 deflates the curtain as it is rolled into its storage position within the shield-like member 102. Thus, the edges of slot 104 should be free of all sharp edges, or other irregularities which might puncture or damage the curtain as it is rolled up or down.

The distant end 110 of the cylinder 102 contains an end fitting 112 for receiving and supporting one end of the roller 108. The other end of the roller may be supported by an end cap (not shown) which fits over the cylindrical shield 102.

Separator means are provided for keeping the curtain sides from clinging to each other. More particularly, each end of the cylindrical shield (i.e., end 110 and the end cap not shown) includes three holes 114,116, 118 which are generally aligned with the spaces between the curtain layers. Three rods 120 are cut to fit into and be supported by the holes 114, 116, 118. These rods are placed between the individual curtain layers, within the cylindrical housing 102 and immediately below or within the deflation groove 104. Therefore, as best seen in FIG. 13, the rods 114, 116 and 118 provide means for separating the individual curtain layers and preventing them from clinging to each other as they run off the roller 108 and hang under gravity over the window. Also, separating the curtain layers near the top of the curtain maximizes the amount of residual air which fills the curtain when it is initially rolled down.

The tracks 100 and horizontal slot 13 through the curtain layer provide a means for accomplishing the inhaling and exhaling functions described above in connection with the embodiment of FIG. 1. The curtain 106 may be raised and lowered manually. The entire unit of FIG. 12 may be preconstructed in a factory and thereafter simply be attached to the front of a window frame.

Those who are skilled in the art will readily perceive still other changes and modifications which may be made in the inventive structure. Therefore, the appended claims are to be construed broadly enough to cover all equivalent structures falling within the scope and the spirit of the invention.

I claim:

1. A curtain for dynamically insulating an area, said curtain comprising a hanging plurality of spaced parallel sheets closed around the perimeter thereof to form an air bag with a variable volume, means in the bottom of at least one of said hanging sheets for admitting or expelling air in an inhalation or exhalation process, means for rolling and unrolling said hanging sheets to enable said curtain to be emplaced in front of or removed from said area, said rolling means including a shield-like member with a deflation groove in a lower region of said shield-like member, said curtain passing through said deflation groove as it is rolled and unrolled, and separator means passing between said hanging plurality of sheets in the vicinity of the deflation groove, whereby said curtain must pass said separator means as said curtain is raised or lowered and thus preclude a clinging together of said sheets.

2. The curtain of claim 1 wherein said shield-like means is a generally cylindrical tube extending over the length of the curtain rolling means, fitting means on at least one end of said tube for supporting a roller from which said curtain is hung, and said separator means comprises at least one rod attached to said fitting means extending between the hanging sheets of said curtain.

3. The curtain of claim 2 wherein there are three of said rods and four of said hanging sheets, said three rods fitting between said four hanging sheets.

4. The curtain of claim 3 wherein said three rods are adjacent said deflation groove.

5. The curtain of claim 4 wherein said insulated area is a window.

6. The curtain of claim 1 wherein track means are included extending vertically beneath and on opposite ends of said deflation groove whereby said curtain moves through said tracks means as said curtain is raised and lowered.

7. The curtain of claim 6 wherein said shield-like means, said track means and said curtain are a single self-contained unit to be mounted on said insulated area.

8. A dynamic insulating curtain comprising a plurality of spaced parallel sheets mounted to move between raised and lowered positions, the perimeter of said sheets being closed to form an air bag, means for separating said sheets as they are moved to at least one of said positions, whereby said sheets are prevented from clinging together, and means for enabling air to freely enter and leave the bottom of the air bag formed by said sheets, whereby said air bag inhales or exhales air responsive to volume changes caused by variations in ambient atmospheric conditions in the vicinity of said curtain.

9. The curtain of claim 8 wherein self-contained means are included for supporting and guiding said air bag as it moves between said raised and lowered positions.

10. The curtain of claim 9 wherein said sheets have open sides which fit within track means that close said perimeter.

11. In a curtain for insulating an area wherein said curtain has a plurality of spaced sheets, and means for drawing said curtain between insulating and noninsulating positions: at least one element located near one end of said curtain and passing between any two adjacent sheets, whereby said curtain must pass said element as it is moved into its insulating position, and said element precludes the sheets from clinging together.

12. The curtain of claim 11 wherein said element comprises a finger extending horizontally across at least a portion of the width of said curtain.

13. The curtain of claim 11 wherein said element comprises a rod extending horizontally across the entire length of said curtain.

14. The curtain of claim 12 or 13 wherein at least one of said elements passes between each pair of sheets.

15. The curtain of claim 11 wherein means are provided for supporting said element on at least one end thereof.

16. The curtain of claim 15 wherein said supporting means hold said element at both ends.

17. The curtain of claim 11 wherein the sheets of said curtain form an air bag with a variable volume, and said curtain has means in at least one of said sheets for admitting or expelling air in an inhalation or exhalation process.

18. The curtain of claim 17 wherein said drawing means includes means for rolling or unrolling said sheets between insulating and non-insulating positions.

19. A process for dynamically insulating an area comprising the steps of:

(a) raising and lowering an air bag to fit over or be removed from said area;

(b) squeezing air out of said air bag when it is removed from said area;

(c) physically separating the sides of said air bag when it is fitted over said area; and (d) enabling air to enter and leave the bottom of said air bag as it changes volume responsive to variations in ambient atmospheric conditions.

20. The process of claim 19 wherein said insulated area is a window.

* * * * *